US011462174B2

(12) United States Patent
Lee

(10) Patent No.: US 11,462,174 B2
(45) Date of Patent: Oct. 4, 2022

(54) PLURALITY OF SCAN DRIVER HAVING SHARED SCAN LINES AND DISPLAY APPARATUS INCLUDING THE SAME

(71) Applicant: LG Display Co., Ltd., Seoul (KR)

(72) Inventor: Tae Keun Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/318,762

(22) Filed: May 12, 2021

(65) Prior Publication Data

US 2021/0366403 A1 Nov. 25, 2021

(30) Foreign Application Priority Data

May 19, 2020 (KR) ..... 10-2020-0059595

(51) Int. Cl.
*G09G 3/3266* (2016.01)
*G09G 3/3225* (2016.01)

(52) U.S. Cl.
CPC ..... *G09G 3/3266* (2013.01); *G09G 3/3225* (2013.01); *G09G 2300/0443* (2013.01); *G09G 2310/08* (2013.01); *G09G 2320/02* (2013.01)

(58) Field of Classification Search
CPC ..... G09G 3/3266
USPC ..... 345/204
See application file for complete search history.

(56) References Cited

U.S. PATENT DOCUMENTS

2016/0379546 A1* 12/2016 Kim ..... G09G 3/2092 345/213
2018/0018920 A1* 1/2018 Kim ..... G09G 3/20
2018/0059497 A1* 3/2018 Lee ..... G09G 3/3677
2019/0035322 A1* 1/2019 Kim ..... H01L 27/1251
2019/0156730 A1* 5/2019 Lim ..... G09G 3/3266
2021/0241673 A1* 8/2021 Liu ..... G09G 3/2092

* cited by examiner

*Primary Examiner* — Long D Pham
(74) *Attorney, Agent, or Firm* — Seed IP Law Group LLP

(57) ABSTRACT

Disclosed herein is a display apparatus including a display panel displaying an image and a scan driver including a one-side stage disposed at one side of the display panel and an other-side stage disposed at the other side of the display panel, wherein each of the one-side stage and the other-side stage includes at least two output terminals, and a first output terminal of the one-side stage and a second output terminal of the other-side stage shares one scan line disposed in the display panel.

11 Claims, 14 Drawing Sheets

PLURALITY OF SCAN DRIVER HAVING SHARED SCAN LINES AND DISPLAY APPARATUS INCLUDING THE SAME

CROSS-REFERENCE TO RELATED APPLICATION(S)

This application claims the benefit of Korean Patent Application No. 10-2020-0059595, filed on May 19, 2020, which is hereby incorporated by reference as if fully set forth herein.

BACKGROUND

Technical Field

The present disclosure relates to a scan driver and a display apparatus including the same.

Description of the Related Art

As information technology advances, the market for display apparatuses which are connection mediums connecting a user to information is growing. Therefore, the use of display apparatuses such as light emitting display apparatuses (LED), quantum dot display apparatuses (QDD), and liquid crystal display apparatuses (LCD) is increasing.

The display apparatuses described above include a display panel which includes a plurality of subpixels, a driver which outputs a driving signal for driving the display panel, and a power supply which supplies power to the display panel or the driver.

In such display apparatuses, when the driving signal (for example, a scan signal and a data signal) is supplied to each of the subpixels provided in the display panel, a selected subpixel may transmit light or may self-emit light, and thus, an image may be displayed.

BRIEF SUMMARY

To overcome the aforementioned problem of the related art, the present disclosure may provide a scan driver and a display apparatus including the same, which reduce an adverse effect caused by an increase in a size or a load (a clock load) of a display panel and uniformize an output characteristic of a scan signal for driving the same scan line, thereby enhancing the display quality of the display apparatus.

To achieve these and other advantages and in accordance with the purpose of the disclosure, as embodied and broadly described herein, a display apparatus includes a display panel displaying an image and a scan driver including a one-side stage disposed at one side of the display panel and an other-side stage disposed at the other side of the display panel, wherein each of the one-side stage and the other-side stage includes at least two output terminals, and a first output terminal of the one-side stage and a second output terminal of the other-side stage shares one scan line disposed in the display panel.

The first output terminal of the one-side stage and the second output terminal of the other-side stage may output a scan signal having the same pulse to the one scan line. Namely, the one-side stage can be considered a first-side stage and the other-side stage can be termed a second-side stage. These can be located on a first side and a second side of the display panel respectively. Accordingly, the stage on the first side may be referred to herein as the first-side stage or the one-side stage and the stage on the second side may be referred to herein as the second-side stage or the other-side stage, each meaning the same thing, respectively.

The one-side stage and the other-side stage may operate based on different clock signals and may simultaneously output a scan signal having the same pulse through the first output terminal of the one-side stage and the second output terminal of the other-side stage.

The different clock signals may include at least two clock signals for generating a logic low pulse with being adjacent to each other.

The one-side stage and the other-side stage may each include the same circuit and may differ in connection structure of clock signal lines.

The one-side stage or the other-side stage may include a first transistor including a gate electrode connected to a fourth clock signal line, a first electrode connected to a start signal line, and a second electrode connected to a first electrode of a third transistor, a 2-1$^{th}$ transistor including a gate electrode connected to a scan low voltage line, a first electrode connected to a gate electrode of a 6-1$^{th}$ transistor, and a second electrode connected to a QA node, a 2-2$^{th}$ transistor including a gate electrode connected to the scan low voltage line, a first electrode connected to a gate electrode of a 6-2$^{th}$ transistor, and a second electrode connected to the QA node, the third transistor including a gate electrode connected to a QB node, the first electrode connected to the second electrode of the first transistor, and a second electrode connected to a scan high voltage line, a fourth transistor including a gate electrode connected to a third clock signal line, a first electrode connected to the scan low voltage line, and a second electrode connected to the QB node, a fifth transistor including a gate electrode connected to the start signal line, a first electrode connected to the QB node, and a second electrode connected to the scan high voltage line, the 6-1$^{th}$ transistor including the gate electrode connected to the first gate of the 2-1$^{th}$ transistor, a first electrode connected to a first clock signal line, and a second electrode connected to a first output terminal, the 6-2$^{th}$ transistor including the gate electrode connected to the first gate of the 2-2$^{th}$ transistor, a first electrode connected to a second clock signal line, and a second electrode connected to a second output terminal, a 7-1$^{th}$ transistor including a gate electrode connected to the QB node, a first electrode connected to the first output terminal, and a second electrode connected to the scan high voltage line, a 7-2$^{th}$ transistor including a gate electrode connected to the QB node, a first electrode connected to the second output terminal, and a second electrode connected to the scan high voltage line, and an eighth transistor including a gate electrode connected to the QA node, a first electrode connected to the QB node, and a second electrode connected to the scan high voltage line.

The one-side stage or the other-side stage may further include a first capacitor connected to the first electrode of the 2-1$^{th}$ transistor at one end thereof and connected to the second electrode of the 6-1$^{th}$ transistor at the other end thereof, a second capacitor connected to the QB node at one end thereof and connected to the scan high voltage line at the other end thereof, and a third capacitor connected to the first electrode of the 2-2$^{th}$ transistor at one end thereof and connected to the second electrode of the 6-2$^{th}$ transistor at the other end thereof.

The one-side stage and the other-side stage may operate based on clock signals configuring a logic low pulse in the order of a third clock signal, a fourth clock signal, a first clock signal, and a second clock signal.

At least one of the one-side stage operates based on the first clock signal and the second clock signal generated adjacent to the first clock signal, at least one of the other-side stage operates based on the first clock signal and the fourth clock signal generated by being spaced apart from the first clock signal.

At least one of the one-side stage starts an operation based on a first start signal, at least one of the other-side stage starts an operation based on a second start signal generated before the first start signal.

In another aspect of the present disclosure, a scan driver includes a first transistor including a gate electrode connected to a fourth clock signal line, a first electrode connected to a start signal line, and a second electrode connected to a first electrode of a third transistor, a 2-1$^{th}$ transistor including a gate electrode connected to a scan low voltage line, a first electrode connected to a gate electrode of a 6-1$^{th}$ transistor, and a second electrode connected to a QA node, a 2-2$^{th}$ transistor including a gate electrode connected to the scan low voltage line, a first electrode connected to a gate electrode of a 6-2$^{th}$ transistor, and a second electrode connected to the QA node, the third transistor including a gate electrode connected to a QB node, the first electrode connected to the second electrode of the first transistor, and a second electrode connected to a scan high voltage line, a fourth transistor including a gate electrode connected to a third clock signal line, a first electrode connected to the scan low voltage line, and a second electrode connected to the QB node, a fifth transistor including a gate electrode connected to the start signal line, a first electrode connected to the QB node, and a second electrode connected to the scan high voltage line, the 6-1$^{th}$ transistor including the gate electrode connected to the first gate of the 2-1$^{th}$ transistor, a first electrode connected to a first clock signal line, and a second electrode connected to a first output terminal, the 6-2$^{th}$ transistor including the gate electrode connected to the first gate of the 2-2$^{th}$ transistor, a first electrode connected to a second clock signal line, and a second electrode connected to a second output terminal, a 7-1$^{th}$ transistor including a gate electrode connected to the QB node, a first electrode connected to the first output terminal, and a second electrode connected to the scan high voltage line, a 7-2$^{th}$ transistor including a gate electrode connected to the QB node, a first electrode connected to the second output terminal, and a second electrode connected to the scan high voltage line, and an eighth transistor including a gate electrode connected to the QA node, a first electrode connected to the QB node, and a second electrode connected to the scan high voltage line.

The scan driver may further include a first capacitor connected to the first electrode of the 2-1$^{th}$ transistor at one end thereof and connected to the second electrode of the 6-1$^{th}$ transistor at the other end thereof, a second capacitor connected to the QB node at one end thereof and connected to the scan high voltage line at the other end thereof, and a third capacitor connected to the first electrode of the 2-2$^{th}$ transistor at one end thereof and connected to the second electrode of the 6-2$^{th}$ transistor at the other end thereof.

BRIEF DESCRIPTION OF THE SEVERAL VIEWS OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Hereinafter, the present disclosure will be described more fully with reference to the accompanying drawings, in which embodiments of the disclosure are shown. The disclosure may, however, be embodied in many different forms and should not be construed as being limited to the embodiments set forth herein; rather, these embodiments are provided so that this disclosure will be thorough and complete, and will fully convey the concept of the disclosure to those skilled in the art.

A display apparatus according to the present disclosure may be applied to televisions (TVs), video players, personal computers (PCs), home theaters, electronic devices for vehicles, and smartphones, but is not limited thereto. The display apparatus according to the present disclosure may be implemented as a light emitting display apparatus (LED), a quantum dot display apparatus (QDD), a liquid crystal display apparatus (LCD), or the like. Hereinafter, however, for convenience of description, a light emitting display apparatus which self-emits light on the basis of an inorganic light emitting diode or an organic light emitting diode will be described for example.

Moreover, an example where a scan driver described below includes a p-type thin film transistor (TFT) will be described, but is not limited thereto and the scan driver may be implemented with an n-type TFT or with an n-type TFT and a p-type TFT. A TFT may be a three-electrode element including a gate, a source, and a drain. The source may be an electrode which provides a carrier to a transistor. In the TFT, a carrier may start to flow from the source. The drain may be an electrode where the carrier flows from the TFT to the outside. That is, in the TFT, the carrier flows from the source to the drain.

In the p-type TFT, because a carrier is a hole, a source voltage may be higher than a drain voltage so that the hole flows from the source to the drain. In the p-type TFT, because the hole flows from the source to the drain, a current may flow from the source to the drain. On the other hand, in the n-type TFT, because a carrier is an electron, a source voltage may have a lower voltage than a drain voltage so that the electron flows from the source to the drain. In the n-type TFT, because the electron flows from the source to the drain, a current may flow from the drain to the source. However, a source and a drain of a TFT may switch therebetween on the basis of a voltage applied thereto. Based thereon, in the following description, one of a source and a drain will be described as a first electrode, and the other of the source and the drain will be described as a second electrode.

Figure 1:
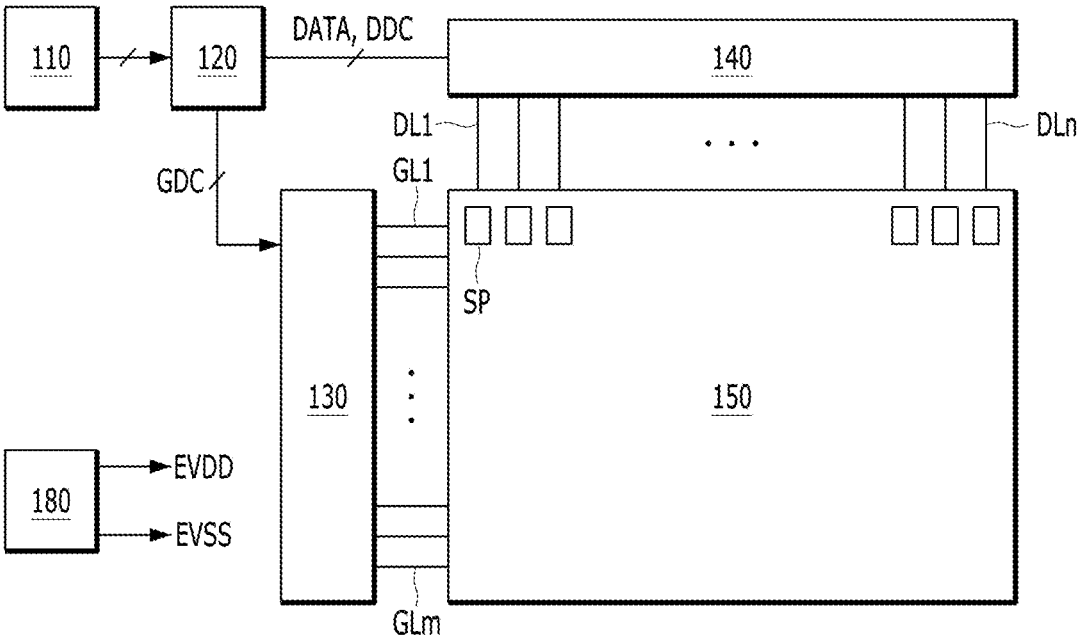
FIG. 1 is a block diagram schematically illustrating a light emitting display apparatus according to an embodiment of the present disclosure.
Figure 2:
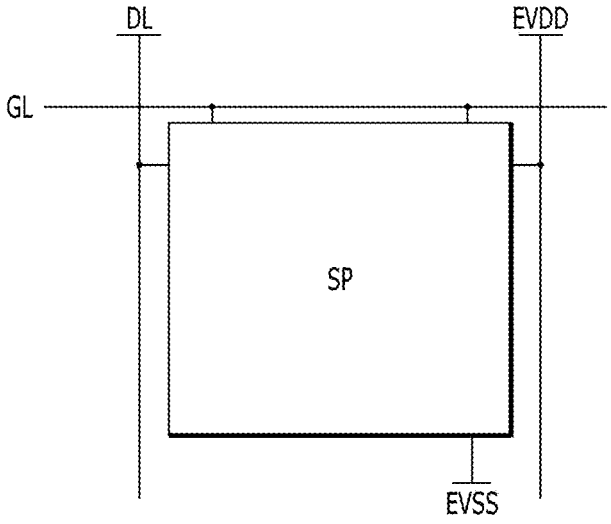
FIG. 2 is a configuration diagram schematically illustrating a subpixel illustrated in FIG. 1.

FIG. 1 is a block diagram schematically illustrating a light emitting display apparatus according to an embodiment of the present disclosure, and FIG. 2 is a configuration diagram schematically illustrating a subpixel illustrated in FIG. 1.

As illustrated in FIGS. 1 and 2, the light emitting display apparatus according to an embodiment of the present disclosure may include a video supply unit 110, a timing controller 120, a scan driver 130, a data driver 140, a display panel 150, and a power supply 180.

The video supply unit 110 (or a host system) may output a video data signal supplied from the outside or a video data signal and various driving signals stored in an internal memory thereof. The video supply unit 110 may supply a data signal and the various driving signals to the timing controller 120.

The timing controller 120 may output a gate timing control signal GDC for controlling an operation timing of the scan driver 130, a data timing control signal DDC for controlling an operation timing of the data driver 140, and various synchronization signals (for example, a vertical synchronization signal Vsync and a horizontal synchronization signal Hsync). The timing controller 120 may provide the data driver 140 with the data timing control signal DDC and a data signal DATA supplied from the video supply unit 110. The timing controller 120 may be implemented as an integrated circuit (IC) type and may be mounted on a printed circuit board (PCB), but is not limited thereto.

The scan driver 130 may output a scan signal (or a scan voltage) in response to the gate timing control signal GDC supplied from the timing controller 120. The scan driver 130 may supply the scan signal to a plurality of subpixels, included in the display panel 150, through a plurality of scan lines GL1 to GLm. The scan driver 130 may be implemented as an IC type or may be directly provided on the display panel 150 in a gate-in panel (GIP) type, but is not limited thereto.

In response to the data timing control signal DDC supplied from the timing controller 120, the data driver 140 may sample and latch the data signal DATA, convert a digital data signal into an analog data voltage on the basis of a gamma reference voltage, and output the analog data voltage. The data driver 140 may respectively supply data voltages to the subpixels of the display panel 150 through a plurality of data lines DL1 to DLn. The data driver 140 may be implemented as an IC type or may be mounted on the display panel 150 or a PCB, but is not limited thereto.

The power supply 180 may generate and output a first panel power EVDD having a high level and a second panel power EVSS having a low level on the basis of an external input voltage supplied from the outside. The power supply unit 180 may generate and output a voltage (for example, a scan high voltage and a scan low voltage) for driving of the scan driver 130 or a voltage (for example, a drain voltage and a half drain voltage) for driving of the data driver 140, in addition to the first panel power EVDD and the second panel power EVSS.

The display panel 150 may display an image on the basis of the scan signal, a driving signal including a data voltage, the first panel power EVDD, and the second panel power EVSS. The subpixels of the display panel 150 may each self-emit light. The display panel 150 may be manufactured based on a substrate, having stiffness or flexibility, such as glass, silicon, or polyimide. Also, the subpixels emitting light may include pixels including red, green, and blue, or may include pixels including red, green, blue, and white.

For example, one subpixel SP may include a pixel circuit which includes a switching transistor, a driving transistor, a storage capacitor, and an organic light emitting diode. The subpixel SP applied to the light emitting display apparatus may self-emit light, and thus, may be complicated in circuit configuration. Also, the subpixel SP may further include various circuits such as a compensation circuit which compensates for a degradation in the organic light emitting diode emitting light and a degradation in the driving transistor supplying a driving current to the organic light emitting diode. Accordingly, it may be assumed that the subpixel SP is simply illustrated in a block form.

Hereinabove, each of the timing controller 120, the scan driver 130, and the data driver 140 has been described as an individual element. However, based on an implementation type of the light emitting display apparatus, one or more of the timing controller 120, the scan driver 130, and the data driver 140 may be integrated into one IC.

Figure 3A:
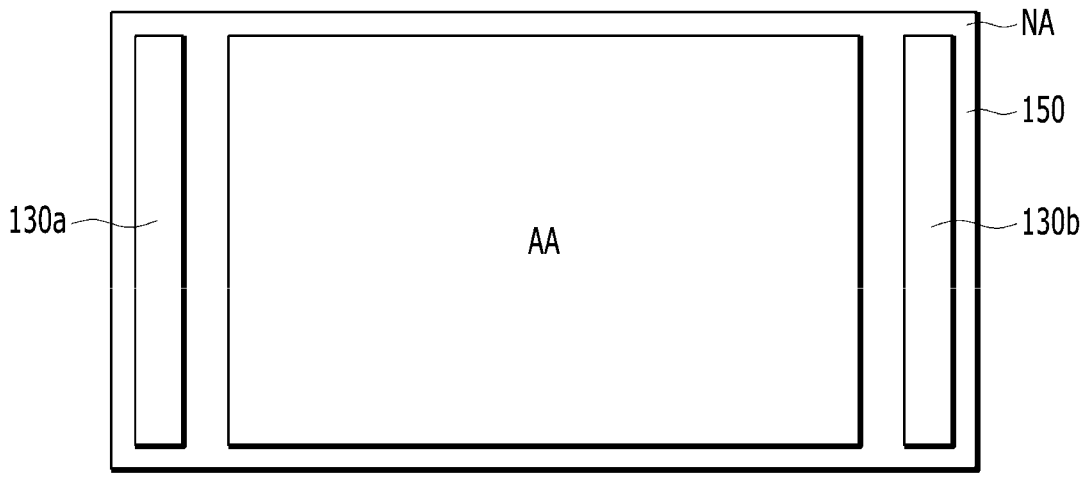
FIGS. 3A and 3B are diagrams illustrating an arrangement example of a gate-in panel (GIP) type scan driver.
Figure 3B:
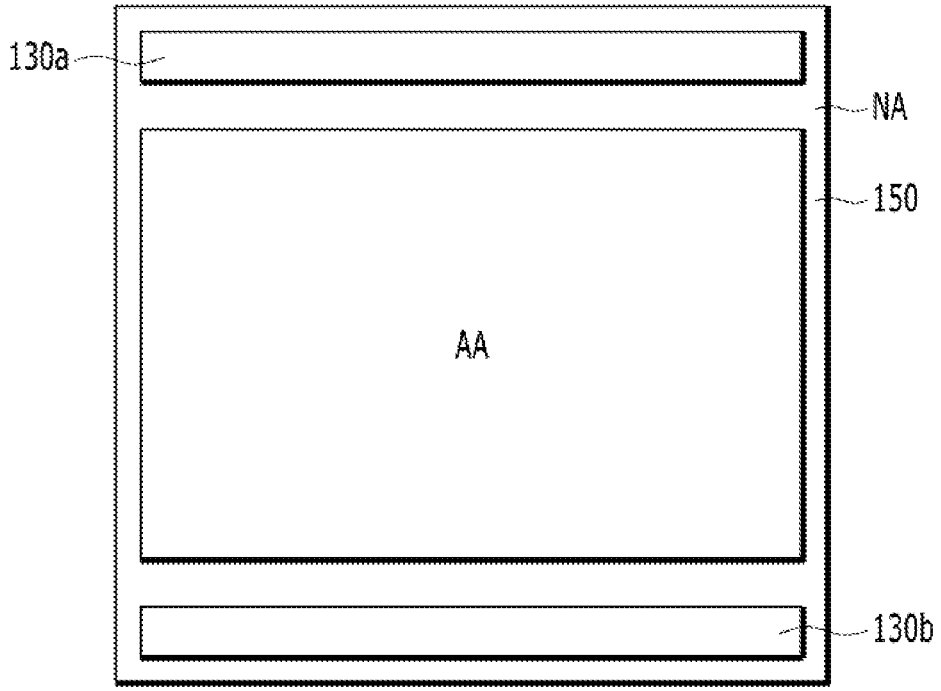
Figure 4:
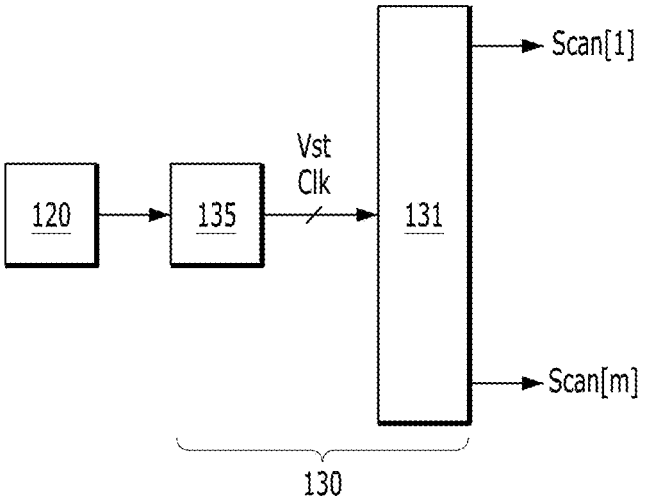
FIGS. 4 and 5 are example diagrams illustrating a configuration of an apparatus associated with the GIP type scan driver.
Figure 5:
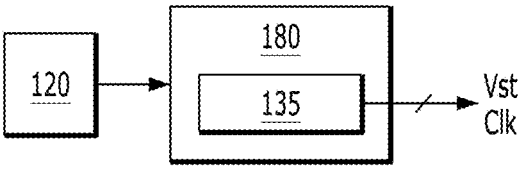
Figure 6:
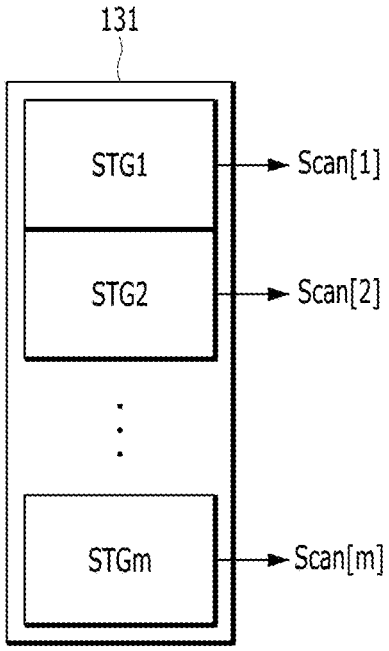
FIG. 6 is a diagram illustrating a stage of a shift register.

FIGS. 3A and 3B are diagrams illustrating an arrangement example of a GIP type scan driver, FIGS. 4 and 5 are example diagrams illustrating a configuration of an apparatus associated with the GIP type scan driver, and FIG. 6 is a diagram illustrating a stage of a shift register.

As illustrated in FIGS. 3A and 3B, a plurality of GIP type scan drivers 130*a* and 130*b* may be disposed in a non-display area NA of a display panel 150. The scan drivers 130*a* and 130*b*, as illustrated in FIG. 3A, may be respectively disposed in a left non-display area NA and a right non-display area NA of the display panel 150. Also, as illustrated in FIG. 3B, the scan drivers 130*a* and 130*b* may be respectively disposed in an upper non-display area NA and a lower non-display area NA of the display panel 150.

An example is illustrated and described where the scan drivers 130*a* and 130*b* are disposed in the non-display area NA disposed at left and right sides or upper and lower sides of a display area AA, opposite each other, but the present disclosure is not limited thereto and the scan drivers 130*a* and 130*b* may be disposed at only one of a left side, a right side, an upper side, or a lower side. If disposed on two sides, these can also be called a first side and a second side, which may be an upper side and a lower side or a right side and a left side. In preferred embodiments, the two sides, namely the first side and the second will be on opposite sides of the display panel based on the way arrays of OLED's are disposed today in display panels. It is possible for the scan driver circuits 130 to be on adjacent sides of the display panel, or even on all four sides, though this is not preferred in the current design of the system or display panel.

As illustrated in FIG. 4, a GIP type scan driver 130 may include a shift register 131 and a level shifter 135. The level shifter 135 may generate and output one or more of a clock signal Clk and a start signal Vst on the basis of signals output from the timing controller 120. The clock signal Clk may be generated and output in a K-phase (where K is an integer of 2 or more) form where phases such as two phases, four phases, and eight phases differ.

The shift register 131 may operate based on the signals Clk and Vst output from the level shifter 135 and may output scan signals Scan[1] to Scan[m] for turning on or off transistors provided in a display panel. The shift register 131 may be implemented as a thin film type in the display panel on the basis of the GIP type. Accordingly, a portion circuits of the scan driver 130 that is included in the display panel may be the shift register 131. Also, 130*a* and 130*b* in FIGS. 3A and 3B may correspond to 131.

As illustrated in FIGS. 4 and 5, unlike the shift register 131, the level shifter 135 may be implemented as an IC type, or may be included in the power supply 180. However, this is merely an embodiment, and the present disclosure is not limited thereto.

As illustrated in FIG. 6, the shift register 131 may include a plurality of stages (for example, first to $M^{th}$ stages) STG1 to STGm. The plurality of stages STG1 to STGm may have a cascade connection relationship for outputting the scan signals Scan[1] to Scan[m] up to the $M^{th}$ stage STGm from the first stage STG1. For example, an output terminal or a carry terminal of the first stage STG1 may be connected to a start signal line which is an input end of the second stage STG2, and an output terminal or a carry terminal of the second stage STG2 may be connected to a start signal line which is an input end of the third stage STG3.

In FIG. 6, an example is illustrated and described where the stages STG1 to STGm included in the shift register 131 output first to $M^{th}$ scan signals Scan[1] to Scan[m] in order. However, the stages STG1 to STGm included in the shift register 131 may output the first to $M^{th}$ scan signals Scan[1] to Scan[m] in order, in reverse order, or randomly on the basis of a control manner.

The reason that a plurality of shift registers 131 are disposed at left and right sides or upper and lower sides of the display panel may be for reducing an adverse effect (an output deviation based on the drop or delay of a voltage of the scan signal and a luminance deviation based thereon) caused by an increase in a size or a load (a load clock) of the display panel. In this case, a circuit may be implemented and may operate to simultaneously output the same scan signal without an output deviation between the shift registers 131 divisionally and respectively disposed at the left and right sides or the upper and lower sides of the display panel.

Hereinafter, therefore, provided may be a method for reducing an output deviation between shift registers divisionally and respectively disposed in the left and right sides or upper and lower sides of the display panel and uniformizing an output characteristic of the scan signal for driving the same scan line. However, an example will be described where the stages STG1 to STGm of the shift register are disposed at the left and right sides of the display panel.

Figure 7:
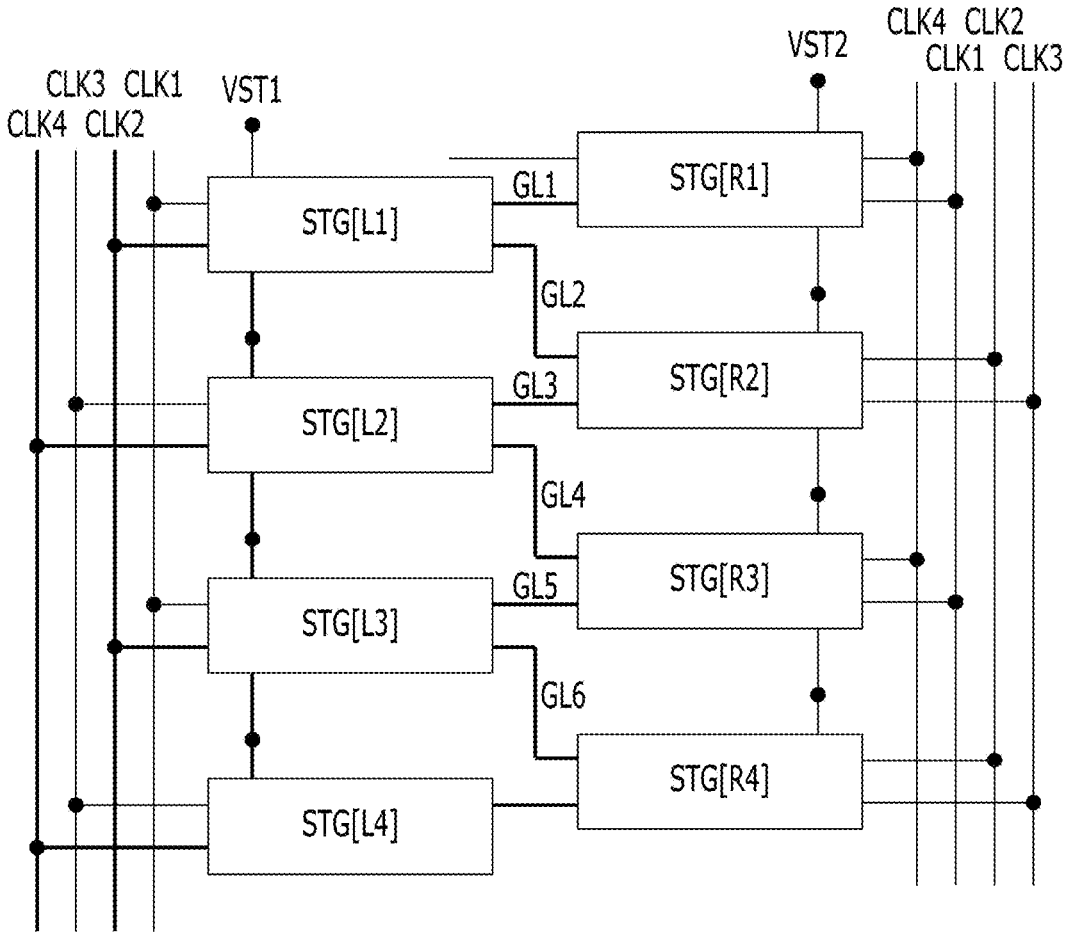
FIG. 7 is a block diagram illustrating stages of a shift register according to an embodiment of the present disclosure.
Figure 8:
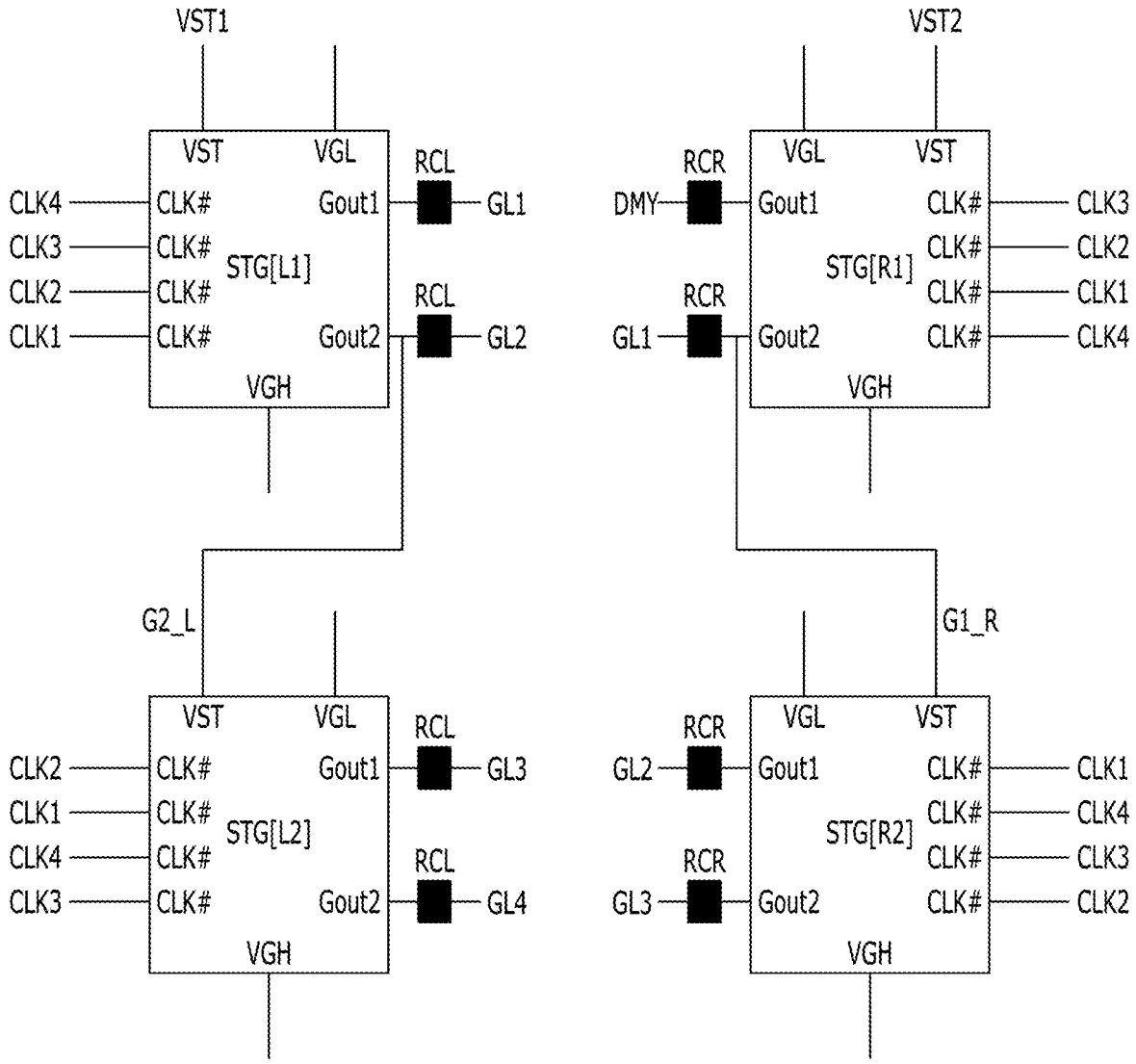
FIG. 8 is a block diagram illustrating in detail left and right stages for driving a first scan line in FIG. 7.
Figure 9:
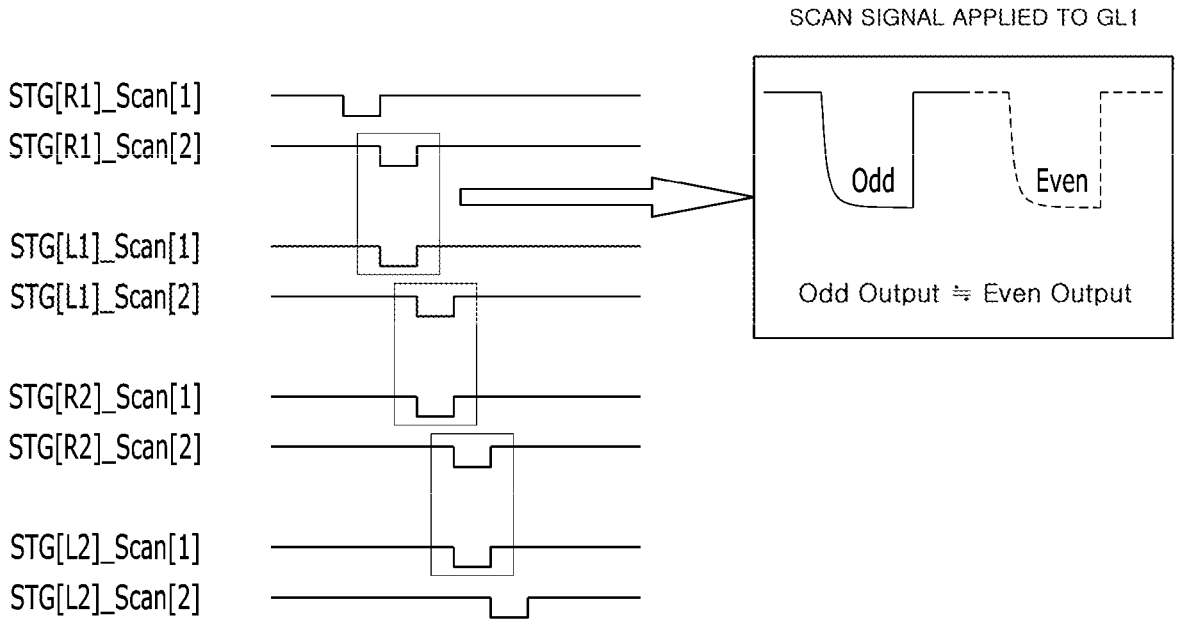
FIG. 9 is a diagram for describing a feature of a shift register according to an embodiment of the present disclosure.

FIG. 7 is a block diagram illustrating stages of a shift register according to an embodiment of the present disclosure, FIG. 8 is a block diagram illustrating in detail left and right stages for driving a first scan line in FIG. 7, and FIG. 9 is a diagram for describing a feature of a shift register according to an embodiment of the present disclosure.

As illustrated in FIG. 7, a shift register 131 according to an embodiment of the present disclosure may include a plurality of left stages STG[L1] to STG[L4] and a plurality of right stages STG[R1] to STG[R4]. Four left stages and four right stages are described for example, and in addition, the shift register 131 of FIG. 7 may further include a plurality of stages. The left stages STG[L1] to STG[L4] can be located in scan driver circuit 130*a* and the right stages STG[R1] to STG[R4] in the scan driver circuit 130*b*. Thus one of them can be referred to as the one-side stage that is located on one side of the display panel and the other referred to as the other-side stage on the other side of the display panel, as can be seen in FIGS. 3A and 3B.

The left stages STG[L1] to STG[L4] may operate based on a first start signal applied thereto through a first start signal line VST1 and first to fourth clock signals applied thereto through first to fourth clock signal lines CLK1 to CLK4. Also, the right stages STG[R1] to STG[R4] may operate based on a second start signal applied thereto through a second start signal line VST2 and the first to fourth clock signals applied thereto through the first to fourth clock signal lines CLK1 to CLK4.

The left stages STG[L1] to STG[L4] and the right stages STG[R1] to STG[R4] may have the same circuit configuration and may be implemented to reduce a deviation between stages sharing a scan line and to output the same scan signal.

To provide a more detailed description, each of the left stages STG[L1] to STG[L4] and the right stages STG[R1] to STG[R4] may include at least two output terminals, but may be connected to the same scan line in a form which is shifted (or shifted to a next stage) by units of one output terminal. Also, stages sharing the same scan line may operate to output a scan signal on the basis of different clock signals (at least two different clock signals for generating a logic low pulse with the different clock signals being adjacent to each other) instead of the same clock signal.

As illustrated in FIG. 8, a first left stage STG[L1] and a first right stage STG[R1] may have the same configuration which includes clock signal lines CLK #, a start signal line VST, a scan low voltage line VGL, a scan high voltage line VGH, a first output terminal Gout1, and a second output terminal Gout2.

The first left stage STG[L1] may have a connection structure where the first output terminal Gout1 is connected to a first scan line GL1 and the second output terminal Gout2 is connected to a second scan line GL2. On the other hand, the first right stage STG[R1] may have a connection structure where the first output terminal Gout1 is connected to a dummy scan line DMY and the second output terminal Gout2 is connected to the first scan line GL1. Such configuration and connection structure may be identically applied to a second left stage STG[L2] and a second right stage STG[R2].

According to the structure, each of the first left stage STG[L1] and the first right stage STG[R1] may include at least two output terminals Gout1 and Gout2 and may have a structure where the output terminal Gout1 of the first left stage STG[L1] and the output terminal Gout2 of the first right stage STG[R1] are connected to each other to share one scan line (or connected to one scan line in common) in a form which is shifted (or shifted to a next stage) by units of one output terminal. In FIG. 8, RCL may denote an RC load of each of the first and second left stages STG[L1] and STG[L2], and RCR may denote an RC load of each of the first and second right stages STG[R1] and STG[R2].

Moreover, the first left stage STG[L1] may have a connection structure which is connected to a fourth clock signal line CLK4, a third clock signal line CLK3, a second clock signal line CLK2, and a first clock signal line CLK1 in the order thereof. On the other hand, the first right stage STG [R1] may have a connection structure which is connected to the third clock signal line CLK3, the second clock signal line CLK2, the first clock signal line CLK1, and the fourth clock signal line CLK4 in the order thereof.

According to the structure, each of the first left stage STG[L1] and the first right stage STG[R1] may share the same scan line and may have a form which is shifted by units of one output terminal, and thus, may operate to output a scan signal on the basis of different clock signals instead of the same clock signal. Such configuration and connection structure may be identically applied to the second left stage STG[L2] and the second right stage STG[R2].

Each of the first left stages STG[L1] and the first right stage STG[R1] and the second left stage STG[L2] and a second right stage STG[R2] may share the same scan line and may be based on the following example so as to be implemented to output a scan signal on the basis of different clock signals instead of the same clock signal, for reducing a clock load.

Like the first left stages STG[L1] and the second left stage STG[L2], stages disposed at a left side may alternately use the second clock signal line CLK2 and the fourth clock signal line CLK4 as a clock signal line associated with generating of a carry signal. Also, like the first right stages STG[R1] and the second right stage STG[R2], stages disposed at a right side may alternately use the first clock signal line CLK1 and the third clock signal line CLK3 as a clock signal line associated with generating of a carry signal. Here, clock signals applied through the first to fourth clock signal lines CLK1 to CLK4 may configure a logic low pulse in the order of a third clock signal, a fourth clock signal, a first clock signal, and a second clock signal. However, an order in which clock signals are generated may be changed based on a configuration of a circuit, but is not limited thereto. Here, G2_L may be a second scan signal which is output through the second output terminal Gout2 of the first left stage STG[L1] and may denote a carry signal which is applied to a start signal line of the second left stage STG [L2]. Here, G1_R may be a first scan signal which is output through the second output terminal Gout2 of the first right stage STG[R1] and may denote a carry signal which is applied to a start signal line of the second right stage STG[R2].

When an apparatus is configured to have a circuit configuration, a connection relationship, and a signal input manner described above, an output deviation caused by a clock load deviation, which is a structural problem of a shift register (shared GIP) where each of left and right stages shares one scan line, may be reduced. The reason is because, when left and right stages operate to output the same scan signal through different output terminals on the basis of different clock signals, all stages may output a carry signal usable as a start signal by alternately using all clock signal instead of two clock signals. That is, a problem may be solved where a carry signal used as a start signal of a next end is limited to specific clock signals, and thus, a clock load may be dispersed, thereby preventing an adverse effect caused by an increase in a load.

As illustrated in FIGS. 7 to 9, when the shift register 131 according to an embodiment of the present disclosure is divisionally disposed at left and right sides of the display panel and operates, the first left stage STG[L1] and the first right stage STG[R1] may apply scan signals STG[R1] Scan[2] and STG[L1] Scan[1] having the same pulse to the display panel through the first scan line GL1 shared thereby.

To provide an additional description, the first right stage STG[R1] and the first left stage STG[L1] may share the same scan line and may output the same scan signal, output terminals thereof for outputting a signal may differ as in FIG. 8, and for example, may be an odd-numbered first output terminal Gout1 of the first left stage STG[L1] and an even-numbered second output terminal Gout2 of the first right stage STG[R1].

Therefore, a scan signal output through the first output terminal Gout1 of the first left stage STG[L1] may be referred to as an odd scan signal Odd, and a scan signal output through the second output terminal Gout2 of the first right stage STG[R1] may be referred to as an even scan signal Even. As described above, a stage and an output terminal for outputting the odd scan signal Odd may differ from a stage and an output terminal for outputting the even scan signal Even, but the odd scan signal Odd and the even scan signal Even may have an almost similar output relationship "Odd output Even output". Accordingly, an output deviation between shift registers may be reduced, and moreover, an output characteristic of a scan signal for driving the same scan line may be uniformized.

As seen in a waveform of FIG. 9, such configuration and operation characteristic may be identically shown in a pair of second left stage STG[L2] and second right stage STG [R1], a pair of third left stage STG[L3] and third right stage STG[R3], and a pair of fourth left stage STG[L4] and fourth right stage STG[R4].

Hereinafter, a circuit configuring a stage will be described.

Figure 10:
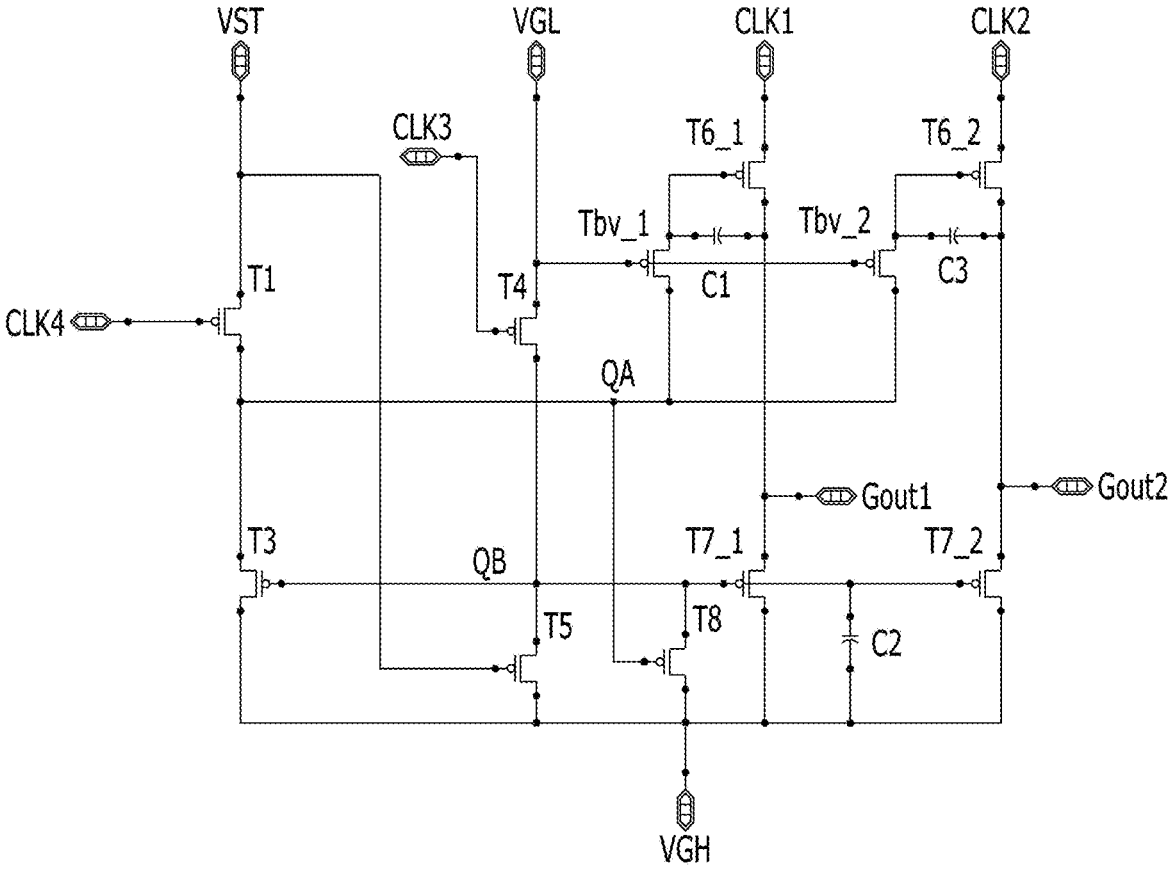
FIG. 10 is an example diagram illustrating a circuit configuration of a stage according to an embodiment of the present disclosure.
Figure 11:
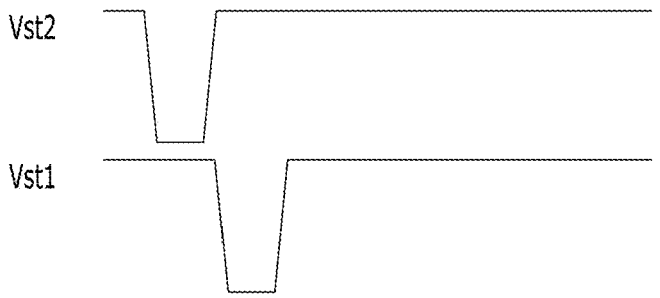
FIGS. 11 and 12 are example waveform diagrams showing an example where start signals and clock signals are applied.
Figure 12:
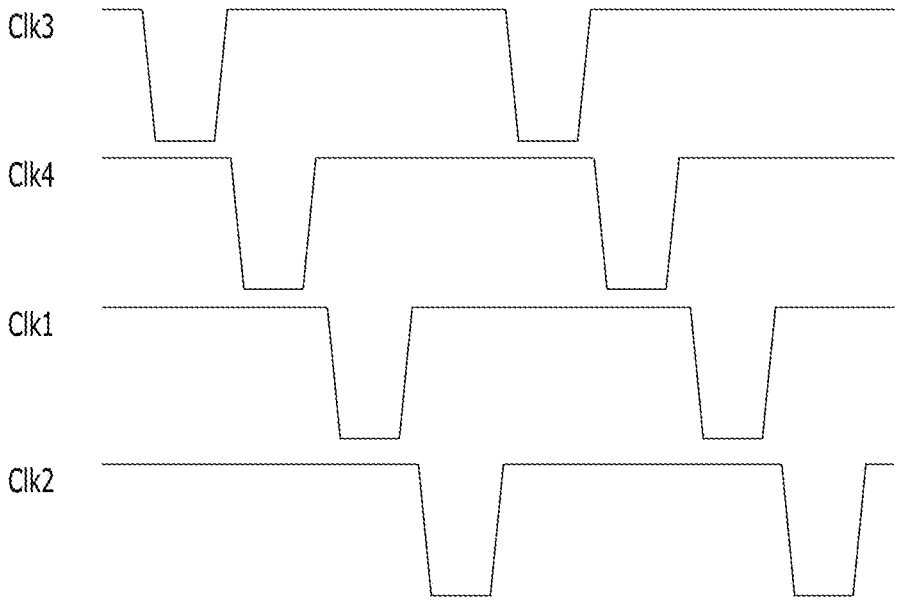
Figure 13:
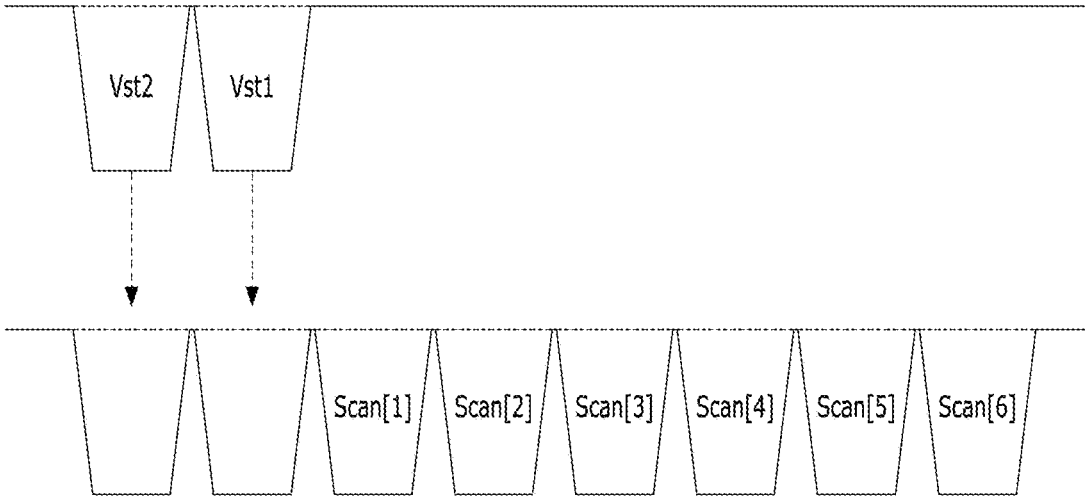
FIG. 13 is an example waveform diagram showing an output form of scan signals.

FIG. 10 is an example diagram illustrating a circuit configuration of a stage according to an embodiment of the present disclosure, FIGS. 11 and 12 are example waveform diagrams showing an example where start signals and clock signals are applied, and FIG. 13 is an example waveform diagram showing an output form of scan signals.

As shown in FIG. 10, one stage may include a first transistor T1, a 2-1$^{th}$ transistor Tbv_1, a 2-2$^{th}$ transistor Tbv_2, a third transistor T3, a fourth transistor T4, a fifth transistor T5, a 6-1$^{th}$ transistor T6_1, a 6-2$^{th}$ transistor T6_2, a 7-1$^{th}$ transistor T7_1, a 7-2$^{th}$ transistor T7_2, an eighth transistor T8, a first capacitor C1, a second capacitor C2, and a third capacitor C3.

The first transistor T1, the 2-1$^{th}$ transistor Tbv_1, the 2-2$^{th}$ transistor Tbv_2, the third transistor T3, the fourth transistor T4, the fifth transistor T5, the eighth transistor T8, the first capacitor C1, the second capacitor C2, and the third capacitor C3 may be defined as a node control circuit. The 6-1$^{th}$ transistor T6_1, the 6-2$^{th}$ transistor T6_2, the 7-1$^{th}$ transistor T7_1, and the 7-2$^{th}$ transistor T7_2 may be defined as an output circuit. The first to eighth transistors T1 to T8 may be defined a p type.

The first transistor T1 may include a gate electrode connected to the fourth clock signal line CLK4, a first electrode connected to the start signal line VST, and a second electrode connected to a first electrode of the third transistor T3. The first transistor T1 may be turned on or off based on the fourth clock signal. When the first transistor T1 is turned on, a QA node QA may be charged with a voltage corresponding to a start signal.

The 2-1$^{th}$ transistor Tbv_1 may include a gate electrode connected to the scan low voltage line VGL, a first electrode connected to a gate electrode of the 6-1$^{th}$ transistor T6_1, and a second electrode connected to the QA node QA. The 2-1$^{th}$ transistor Tbv_1 may be turned on or off based on a scan low voltage. When the 2-1$^{th}$ transistor Tbv_1 is turned on, a node connected to the gate electrode of the 6-1$^{th}$ transistor T6_1 may receive a voltage of the QA node QA.

The 2-2$^{th}$ transistor Tbv_2 may include a gate electrode connected to the scan low voltage line VGL, a first electrode connected to a gate electrode of the 6-2$^{th}$ transistor T6_2, and a second electrode connected to the QA node QA. The 2-2$^{th}$ transistor Tbv_2 may be turned on or off based on the scan low voltage. When the 2-2$^{th}$ transistor Tbv_2 is turned on, a node connected to the gate electrode of the 6-2$^{th}$ transistor T6_2 may receive a voltage of the QA node QA.

The third transistor T3 may include a gate electrode connected to a QB node QB, a first electrode connected to the second electrode of the first transistor T1, and a second electrode connected to a scan high voltage line VGH. The third transistor T3 may be turned on or off based on a voltage of the QB node QB. When the third transistor T3 is turned on, the QA node QA may receive a scan high voltage.

The fourth transistor T4 may include a gate electrode connected to the third clock signal line CLK3, a first electrode connected to the scan low voltage line VGL, and a second electrode connected to the QB node QB. The fourth transistor T4 may be turned on or off based on the third clock signal. When the fourth transistor T4 is turned on, the QB node QB may receive the scan low voltage.

The fifth transistor T5 may include a gate electrode connected to the start signal line VST, a first electrode connected to the QB node QB, and a second electrode connected to the scan high voltage line VGH. The fifth transistor T5 may be turned on or off based on the start signal. When the fifth transistor T5 is turned on, the QB node QB may receive the scan high voltage.

One end of the first capacitor C1 may be connected to the first electrode of the 2-1$^{th}$ transistor Tbv_1, and the other end thereof may be connected to the second electrode of the 6-1$^{th}$ transistor T6_1. One end of the second capacitor C2 may be connected to the QB node QB, and the other end thereof may be connected to the scan high voltage line VGH. One end of the third capacitor C3 may be connected to the first electrode of the 2-2$^{th}$ transistor Tbv_2, and the other end thereof may be connected to the second electrode of the 6-2$^{th}$ transistor T6_2. The first to third capacitors C1 to C3 may help corresponding transistors maintain a stable output for a long time.

The 6-1$^{th}$ transistor T6_1 may include a gate electrode connected to the first gate of the 2-1$^{th}$ transistor Tbv_1, a first electrode connected to the first clock signal line CLK1, and a second electrode connected to the first output terminal Gout1 of the stage. The 6-1$^{th}$ transistor T6_1 may be turned on or off based on a voltage transferred from the 2-1$^{th}$ transistor Tbv_1. When the 6-1$^{th}$ transistor T6_1 is turned on, the first clock signal may be output as a first scan signal having a logic low level through the first output terminal Gout1.

The 6-2$^{th}$ transistor T6_2 may include a gate electrode connected to the first gate of the 2-2$^{th}$ transistor Tbv_2, a first electrode connected to the second clock signal line CLK2, and a second electrode connected to the second output terminal Gout2 of the stage. The 6-2$^{th}$ transistor T6_2 may be turned on or off based on a voltage transferred from the 2-2$^{th}$ transistor Tbv_2. When the 6-2$^{th}$ transistor T6_2 is turned on, the second clock signal may be output as a second scan signal having a logic low level through the second output terminal Gout2.

The 7-1th transistor T7_1 may include a gate electrode connected to the QB node QB, a first electrode connected to the first output terminal Gout1 of the stage, and a second electrode connected to the scan high voltage line VGH. The 7-1th transistor T7_1 may be turned on or off based on the voltage of the QB node QB. When the 7-1$^{th}$ transistor T7_1 is turned on, the scan high voltage may be output as the first scan signal having a logic high level through the first output terminal Gout1.

The 7-2$^{th}$ transistor T7_2 may include a gate electrode connected to the QB node QB, a first electrode connected to the second output terminal Gout2 of the stage, and a second electrode connected to the scan high voltage line VGH. The 7-2$^{th}$ transistor T7_2 may be turned on or off based on the voltage of the QB node QB. When the 7-2$^{th}$ transistor T7_2 is turned on, the scan high voltage may be output as the second scan signal having a logic high level through the second output terminal Gout2.

The eighth transistor T8 may include a gate electrode connected to the QA node QA, a first electrode connected to the QB node QB, and a second electrode connected to the scan high voltage line VGH. The eighth transistor T8 may be turned on or off based on the voltage of the QA node QA. When the eighth transistor T8 is turned on, the QB node QB may receive the scan high voltage.

The stage described above may start to operate based on the first start signal Vst1 or the second start signal Vst2 as shown in FIG. 11. Also, the stage described above may operate based on the clock signals CLK1 to CLK4 as shown in FIG. 12 to output a scan signal. In this case, the clock signals CLK1 to CLK4 may configure a logic low pulse in the order of the third clock signal line CLK3, the fourth clock signal line CLK4, the first clock signal line CLK1, and the second clock signal line CLK2.

Moreover, as shown in FIG. 13, when the second start signal Vst2 having a logic low level and the first start signal Vst1 having a logic low level are all applied to the stage described above, the stage may sequentially output the scan signals Scan[1] to Scan[6]. In this case, the scan signals Scan[1] to Scan[6] may configure a logic low pulse sequentially up to the sixth scan signal Scan[6] from the first scan signal Scan[1].

Hereinafter, an operation of the stage described above will be described.

FIGS. 14 to 17 are diagrams for helping understand an operation of a stage according to an embodiment of the present disclosure.

As illustrated in FIGS. 14 to 17, the first transistor T1 may be turned on based on the fourth clock signal CLK4 having a logic low level. When the first transistor T1 is turned on, the start signal Vst having a logic low level may be transferred to the QA node QA, and the QA node QA may have a logic low voltage. A logic low voltage generated in the QA node QA may correspond to a voltage for turning on a p-type transistor, and thus, the QA node QA may be charged with a logic low voltage.

When the QA node QA is charged, bootstrapping may occur in a first node defined between the first electrode of the 2-1$^{th}$ transistor Tbv_1 and the gate electrode of the 6-1$^{th}$ transistor T6_1 and a second node defined between the first electrode of the 2-2$^{th}$ transistor Tbv_2 and the gate electrode of the 6-2$^{th}$ transistor T6_2.

Figure 14:
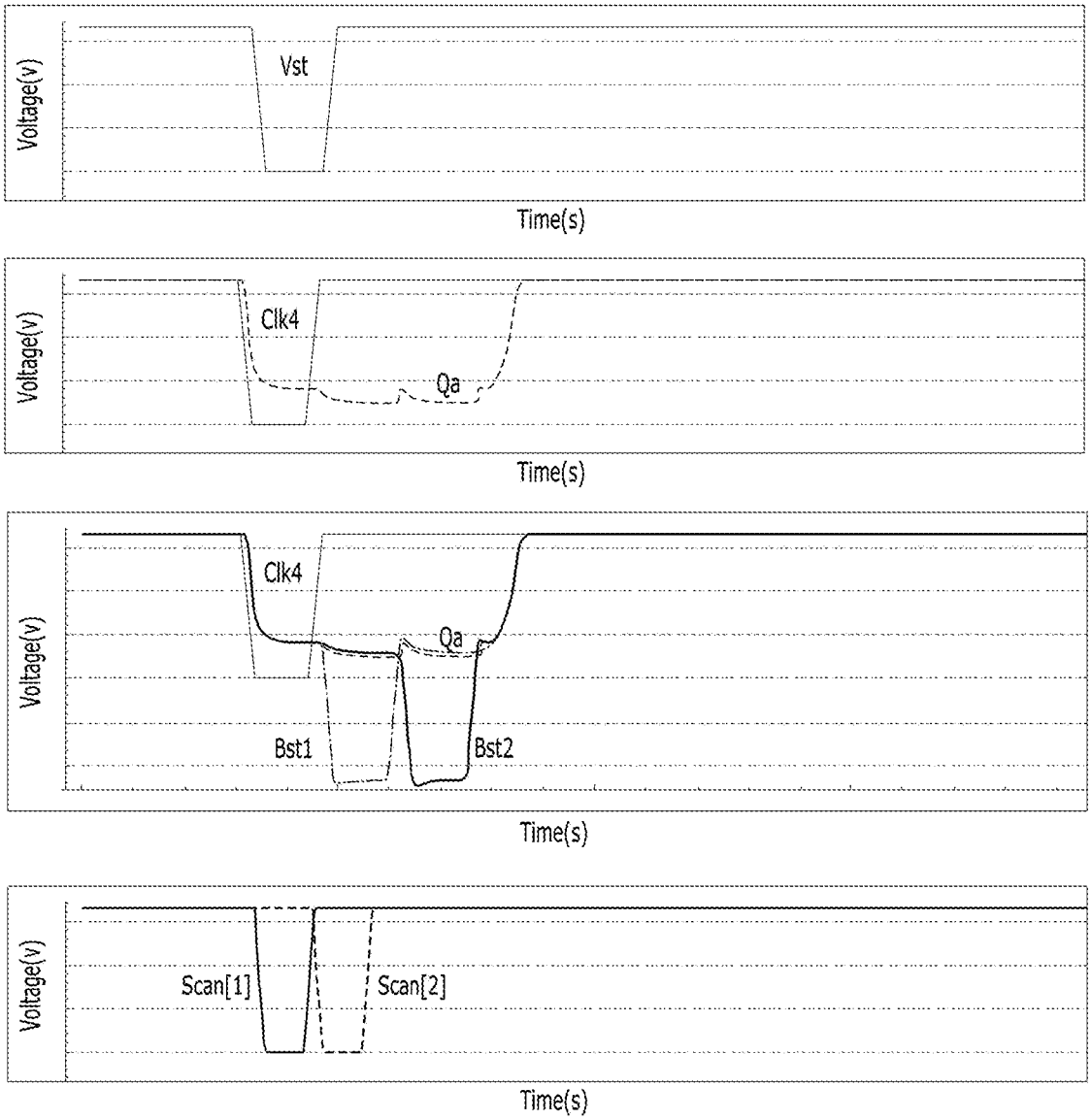
FIGS. 14 to 17 are diagrams for helping understand an operation of a stage according to an embodiment of the present disclosure.

When bootstrapping occurs in the first node and the second node, a voltage (or a level) may sequentially increase as in a first node voltage Bst1 and a second node voltage Bst2 of FIG. 14. In this case, the first node voltage Bst1 may be relevant to the first clock signal applied to the 6-1$^{th}$ transistor T6_1, and thus, the first scan signal which is to be used as an odd scan signal G1 may be output through the first output terminal Gout1. Also, the second node voltage Bst2 may be relevant to the second clock signal applied to the 6-2th transistor T6_2, and thus, the second scan signal which is to be used as an even scan signal G2 may be output through the second output terminal Gout2.

Figure 15:
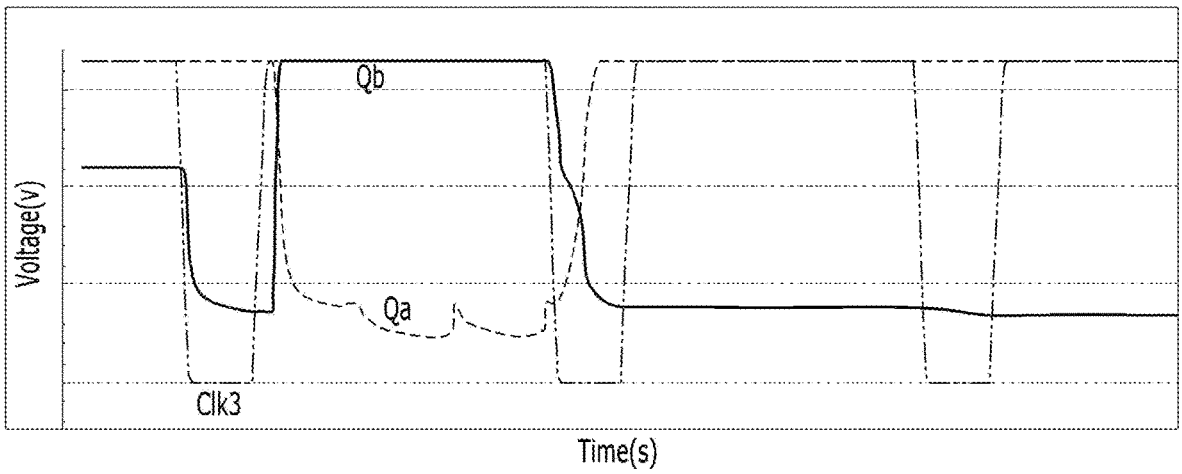

As illustrated in FIG. 15, a voltage Qa of the QA node QA may be opposite to a voltage Qb of the QB node QB. When a scan signal having a logic low level is output through the first output terminal Gout1 or the second output terminal Gout2, the voltage Qa of the QA node QA may have a logic low voltage (a charge voltage), and the voltage Qb of the QB node QB may have a logic high voltage (a discharge voltage). On the other hand, when a scan signal having a logic high level is output through the first output terminal Gout1 or the second output terminal Gout2, the voltage Qa of the QA node QA may have a logic high voltage (a discharge voltage), and the voltage Qb of the QB node QB may have a logic low voltage (a charge voltage).

Figure 16:
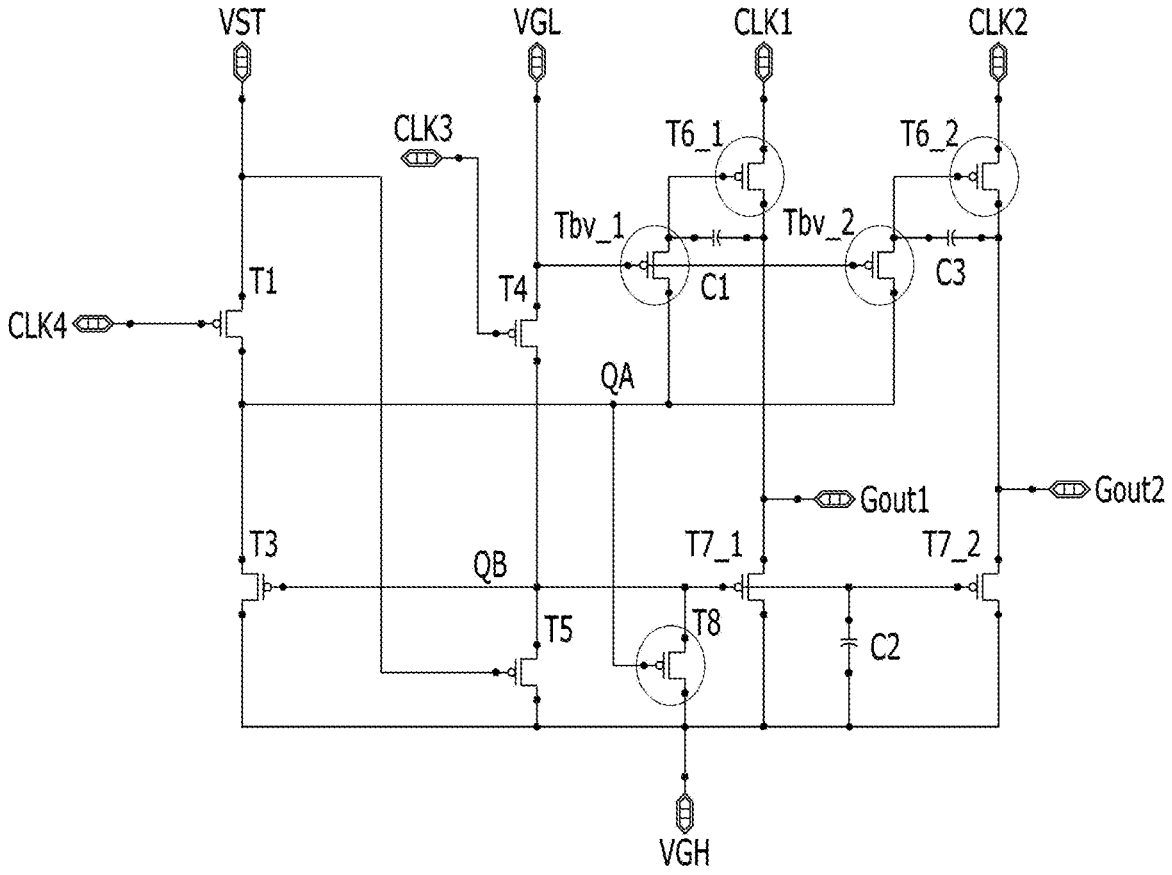

As illustrated in FIGS. 14 and 16, the 2-1$^{th}$ transistor Tbv_1, the 6-1$^{th}$ transistor T6_1, and the eighth transistor T8 may maintain a turn-on state while the odd scan signal G1 having a logic low level is being output through the first output terminal Gout1. Also, the 2-2$^{th}$ transistor Tbv_2, the 6-2$^{th}$ transistor T6_2, and the eighth transistor T8 may maintain a turn-on state while the even scan signal G2 having a logic low level is being output through the second output terminal Gout2.

Figure 17:
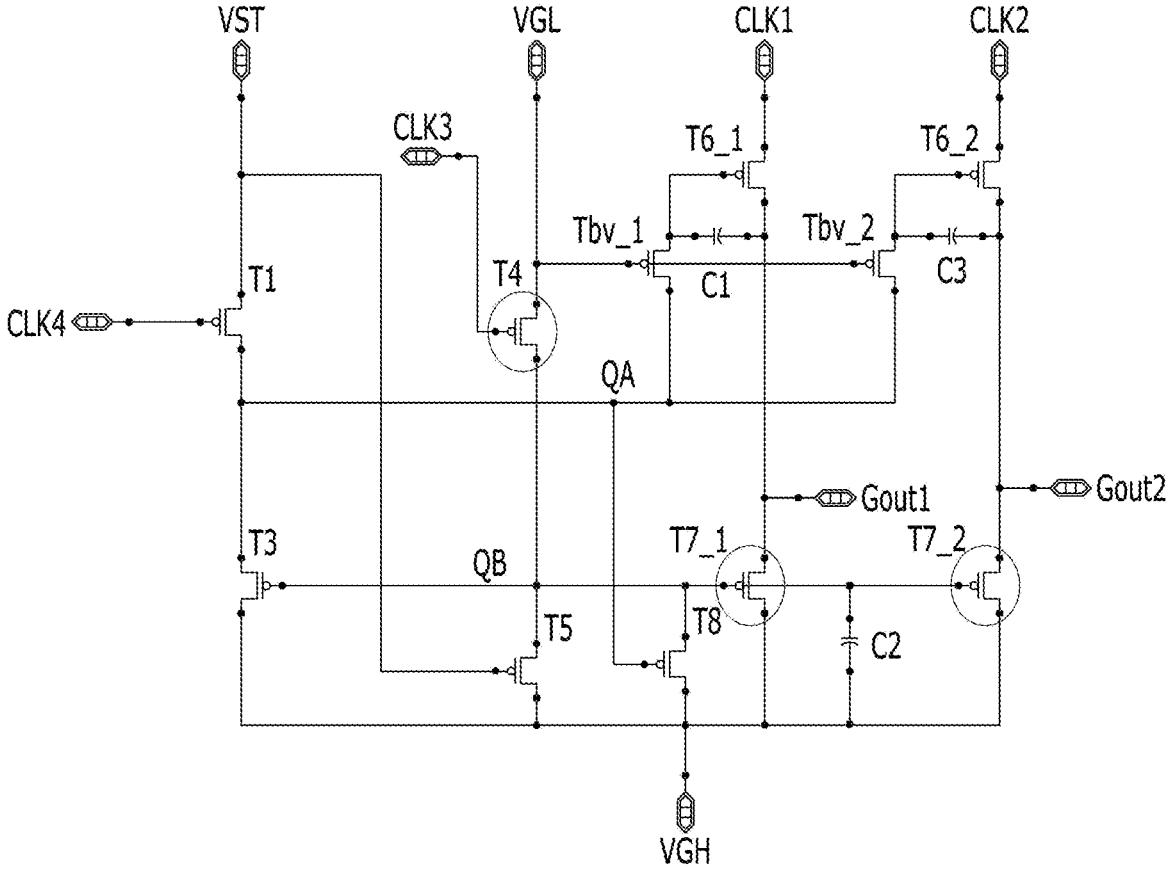

As illustrated in FIGS. 14 and 17, the 7-1$^{th}$ transistor T7_1 and the fourth transistor T4 may maintain a turn-on state while the odd scan signal G1 having a logic high level is being output through the first output terminal Gout1. Also, the 7-2th transistor T7_2 and the fourth transistor T4 may maintain a turn-on state while the even scan signal G2 having a logic high level is being output through the second output terminal Gout2.

As described above, according to the embodiments of the present disclosure, an adverse effect (an output deviation based on the drop or delay of a voltage of a scan signal and a luminance deviation based thereon) caused by an increase in a size or a load (a load clock) of a display panel may be reduced, and thus, the display quality of a display apparatus may be enhanced. Also, according to the embodiments of the present disclosure, an output deviation between shift registers divisionally and respectively disposed at left and right sides or upper and lower sides of the display panel may be reduced, and moreover, an output characteristic of a scan signal for driving the same scan line may be uniformized.

The effects according to the present disclosure are not limited to the above examples, and other various effects may be included in the specification.

While the present disclosure has been particularly shown and described with reference to embodiments thereof, it will be understood by those of ordinary skill in the art that various changes in form and details may be made therein without departing from the spirit and scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display apparatus comprising:

a display panel displaying an image; and a scan driver including a one-side stage disposed at one side of the display panel and an other-side stage disposed at the other side of the display panel, wherein each of the one-side stage and the other-side stage includes at least two output terminals, and a first output terminal of the one-side stage and a second output terminal of the other-side stage shares one scan line disposed in the display panel, wherein either the one-side stage or the other-side stage comprises:

a first transistor including a gate electrode connected to a fourth clock signal line, a first electrode connected to a start signal line, and a second electrode connected to a first electrode of a third transistor;

a 2-1$^{th}$ transistor including a gate electrode connected to a scan low voltage line, a first electrode connected to a gate electrode of a 6-1$^{th}$ transistor, and a second electrode connected to a QA node;

a 2-2$^{th}$ transistor including a gate electrode connected to the scan low voltage line, a first electrode connected to a gate electrode of a 6-2$^{th}$ transistor, and a second electrode connected to the QA node;

a third transistor including a gate electrode connected to a QB node, the first electrode connected to the second electrode of the first transistor, and a second electrode connected to a scan high voltage line;

a fourth transistor including a gate electrode connected to a third clock signal line, a first electrode connected to the scan low voltage line, and a second electrode connected to the QB node;

a fifth transistor including a gate electrode connected to the start signal line, a first electrode connected to the QB node, and a second electrode connected to the scan high voltage line;

the 6-1$^{th}$ transistor including the gate electrode connected to the first gate of the 2-1$^{th}$ transistor, a first electrode connected to a first clock signal line, and a second electrode connected to a first output terminal;

the 6-2$^{th}$ transistor including the gate electrode connected to the first gate of the 2-2$^{th}$ transistor, a first electrode connected to a second clock signal line, and a second electrode connected to a second output terminal;

a 7-1$^{th}$ transistor including a gate electrode connected to the QB node, a first electrode connected to the first output terminal, and a second electrode connected to the scan high voltage line;

a 7-2$^{th}$ transistor including a gate electrode connected to the QB node, a first electrode connected to the second output terminal, and a second electrode connected to the scan high voltage line; and an eighth transistor including a gate electrode connected to the QA node, a first electrode connected to the QB node, and a second electrode connected to the scan high voltage line.

2. The display apparatus of claim 1, wherein the first output terminal of the one-side stage and the second output terminal of the other-side stage output a scan signal having a same pulse as the one scan line.

3. The display apparatus of claim 2, wherein the one-side stage and the other-side stage operate based on different clock signals and simultaneously output a scan signal having the same pulse through the first output terminal of the one-side stage and the second output terminal of the other-side stage.

4. The display apparatus of claim 3, wherein the different clock signals comprise at least two clock signals for generating a logic low pulse with the at least two clock signals being adjacent to each other.

5. The display apparatus of claim 1, wherein the one-side stage and the other-side stage each comprise the same circuit and differ in connection structure of clock signal lines.

6. The display apparatus of claim 1, wherein either the one-side stage or the other-side stage further comprises:

a first capacitor connected to the first electrode of the 2-1$^{th}$ transistor at one end thereof and connected to the second electrode of the 6-1$^{th}$ transistor at the other end thereof;

a second capacitor connected to the QB node at one end thereof and connected to the scan high voltage line at the other end thereof; and a third capacitor connected to the first electrode of the 2-2$^{th}$ transistor at one end thereof and connected to the second electrode of the 6-2$^{th}$ transistor at the other end thereof.

7. The display apparatus of claim 1, wherein the one-side stage and the other-side stage operate based on clock signals configuring a logic low pulse in the order of a third clock signal, a fourth clock signal, a first clock signal, and a second clock signal.

8. The display apparatus of claim 7, wherein at least one of the one-side stage operates based on the first clock signal and the second clock signal generated adjacent to the first clock signal, at least one of the other-side stage operates based on the first clock signal and the fourth clock signal generated by being spaced apart from the first clock signal.

9. The display apparatus of claim 8, wherein at least one of the one-side stage starts an operation based on a first start signal, at least one of the other-side stage starts an operation based on a second start signal generated before the first start signal.

10. A scan driver, comprising:

a first transistor including a gate electrode connected to a fourth clock signal line, a first electrode connected to a start signal line, and a second electrode connected to a first electrode of a third transistor;

a 2-1$^{th}$ transistor including a gate electrode connected to a scan low voltage line, a first electrode connected to a gate electrode of a 6-1$^{th}$ transistor, and a second electrode connected to a QA node;

a 2-2$^{th}$ transistor including a gate electrode connected to the scan low voltage line, a first electrode connected to a gate electrode of a 6-2$^{th}$ transistor, and a second electrode connected to the QA node;

a third transistor including a gate electrode connected to a QB node, the first electrode connected to the second electrode of the first transistor, and a second electrode connected to a scan high voltage line;

a fourth transistor including a gate electrode connected to a third clock signal line, a first electrode connected to the scan low voltage line, and a second electrode connected to the QB node;

a fifth transistor including a gate electrode connected to the start signal line, a first electrode connected to the QB node, and a second electrode connected to the scan high voltage line;

the 6-1$^{th}$ transistor including the gate electrode connected to the first gate of the 2-1$^{th}$ transistor, a first electrode connected to a first clock signal line, and a second electrode connected to a first output terminal;

the 6-2$^{th}$ transistor including the gate electrode connected to the first gate of the 2-2$^{th}$ transistor, a first electrode connected to a second clock signal line, and a second electrode connected to a second output terminal;

a 7-1$^{th}$ transistor including a gate electrode connected to the QB node, a first electrode connected to the first output terminal, and a second electrode connected to the scan high voltage line;

a 7-2$^{th}$ transistor including a gate electrode connected to the QB node, a first electrode connected to the second output terminal, and a second electrode connected to the scan high voltage line; and an eighth transistor including a gate electrode connected to the QA node, a first electrode connected to the QB node, and a second electrode connected to the scan high voltage line.

11. The scan driver of claim 10, further comprising:

a first capacitor connected to the first electrode of the 2-1$^{th}$ transistor at one end thereof and connected to the second electrode of the 6-1$^{th}$ transistor at the other end thereof;

a second capacitor connected to the QB node at one end thereof and connected to the scan high voltage line at the other end thereof; and a third capacitor connected to the first electrode of the 2-2$^{th}$ transistor at one end thereof and connected to the second electrode of the 6-2$^{th}$ transistor at the other end thereof.

* * * * *